US011013375B2

(12) United States Patent
Banks et al.

(10) Patent No.: US 11,013,375 B2
(45) Date of Patent: May 25, 2021

(54) WIPES WITH FOAM

(71) Applicant: DEB IP LIMITED, Derbyshire (GB)

(72) Inventors: Stewart Banks, Derbyshire (GB); Dean Limbert, Derbyshire (GB); Chris Lang, Derbyshire (GB); Jack Kidd, Derbyshire (GB); Robert Butler, Derbyshire (GB)

(73) Assignee: DEB IP LIMITED, Derbyshire (GB)

( * ) Notice: Subject to any disclaimer, the term of this patent is extended or adjusted under 35 U.S.C. 154(b) by 215 days.

(21) Appl. No.: 15/772,780

(22) PCT Filed: Oct. 25, 2016

(86) PCT No.: PCT/GB2016/053317
§ 371 (c)(1),
(2) Date: May 1, 2018

(87) PCT Pub. No.: WO2017/077269
PCT Pub. Date: May 11, 2017

(65) Prior Publication Data

US 2019/0231148 A1 Aug. 1, 2019

Related U.S. Application Data

(60) Provisional application No. PCT/GB2016/053317, filed on Oct. 25, 2016.

(30) Foreign Application Priority Data

Nov. 2, 2015 (GB) ..... 1519298

(51) Int. Cl.
*A47K 5/14* (2006.01)
*A47K 5/12* (2006.01)
(Continued)

(52) U.S. Cl.
CPC ..... *A47K 5/14* (2013.01); *A47K 5/1207* (2013.01); *B05B 7/0037* (2013.01);
(Continued)

(58) Field of Classification Search
CPC ..... A47K 5/14; A47K 5/1207; A47K 5/16; A47K 5/1211; C11D 17/046;
(Continued)

(56) References Cited

U.S. PATENT DOCUMENTS 4,018,364 A 4/1977 Wright
4,156,505 A 5/1979 Bennett
(Continued)

FOREIGN PATENT DOCUMENTS

CA 2861544 A1 2/2016
EP 2545833 A2 1/2013
WO 2014/031379 A1 2/2014

OTHER PUBLICATIONS

International Search Report and Written Opinion in International Patent Application No. PCT/GB2016/053317, dated Jan. 20, 2017.
(Continued)

*Primary Examiner* — Donnell A Long
(74) *Attorney, Agent, or Firm* — Venable LLP; Henry J. Daley

(57) ABSTRACT

A foaming component for use in a foaming liquid dispenser, and an insert arranged so that it may be inserted into a liquid dispenser comprising the foaming component. The foaming component comprises a liquid chamber; an air chamber; a sparging component, which comprises a sparging interface and a foaming region; an exit aperture; and a pumping mechanism. The pumping mechanism is arranged such that it can transfer liquid from the liquid chamber directly to the foaming region, and air from the air chamber to the foaming region, via the sparging interface. The forcing of air through
(Continued)

the sparging interface causes bubbles to form in the liquid located in the foaming region, resulting in a foamed mixture for dispensing. The pumping mechanism is then used to transfer the foamed mixture from the sparging component through the exit aperture, wherein the sparging interface is arranged such that at least a portion of the foaming region is positioned in between opposing surfaces of the sparging interface.

35 Claims, 9 Drawing Sheets

(51) Int. Cl.

| | |
|---|---|
| ***B05B 7/00*** | (2006.01) |
| ***B05B 11/00*** | (2006.01) |
| ***C11D 11/00*** | (2006.01) |
| ***C11D 17/04*** | (2006.01) |
| *C11D 17/00* | (2006.01) |

(52) U.S. Cl.
CPC ..... *B05B 11/3087* (2013.01); *C11D 11/0058* (2013.01); *C11D 17/046* (2013.01); *C11D 17/0013* (2013.01); *C11D 17/041* (2013.01)

(58) Field of Classification Search
CPC ..... C11D 11/0058; C11D 17/041; C11D 17/0013; B05B 11/3087; B05B 7/0037; B05B 7/0018
USPC ..... 222/190
See application file for complete search history.

(56) References Cited

U.S. PATENT DOCUMENTS

| | | | | |
|---|---|---|---|---|
| 4,991,779 | A | 2/1991 | Blake, III | |
| 5,238,155 | A * | 8/1993 | Blake | A45D 27/10 222/190 |
| 5,445,288 | A | 8/1995 | Banks | |
| 6,082,586 | A | 7/2000 | Banks | |
| 7,661,561 | B2 | 2/2010 | Ophardt et al. | |
| 8,002,151 | B2 | 8/2011 | Matthews et al. | |
| 2007/0278247 | A1 | 12/2007 | Banks et al. | |
| 2009/0184136 | A1 | 7/2009 | Ciavarella | |
| 2014/0054323 | A1* | 2/2014 | McNulty | A47K 5/1211 222/190 |
| 2015/0209811 | A1* | 7/2015 | Ophardt | B05B 11/3001 222/190 |
| 2015/0272398 | A1* | 10/2015 | Arminak | B05B 11/3059 222/190 |
| 2015/0328652 | A1* | 11/2015 | Yamada | B05B 7/0062 222/190 |

OTHER PUBLICATIONS

United Kingdom Intellectual Property Office Search Report dated Apr. 25, 2016.
Intellectual Property Office of Singapore Office Action dated Mar. 5, 2019.
United Kingdom Intellectual Property Office Examination Report dated Jul. 13, 2020.

* cited by examiner

WIPES WITH FOAM

This application is a U.S. National Stage Application under 35 U.S.C. § 371 of PCT/GB2016/053317, filed on Oct. 25, 2016, the entire content of which is hereby incorporated by reference, and claims the benefit of Great Britain Patent Application No. 1519298.2, filed Nov. 2, 2015.

FIELD

The invention relates to a foaming component, and particularly to a foaming component for a foaming liquid dispenser and an insert arranged to be inserted into a liquid dispenser comprising the foaming component.

BACKGROUND

Liquid dispensers for dispensing liquid soap and other liquids are employed for purposes such as promoting hygiene. Such liquid dispensers can be manual, in which case the delivery mechanism relies upon external mechanical actuation such as the depressing of a lever, or can be automatic, in which case the delivery mechanism does not rely upon external mechanical actuation and can take a hands-free form in which the liquid dispenser electromechanically actuates based on the readings from a motion sensor detecting motion, for example, from a hand external to the liquid dispenser.

Management of contamination is a key factor in maintaining and promoting hygiene and in preventing the liquid dispenser itself from becoming contaminated and therefore compromised. In the worst case scenario, instead of promoting hygiene through destroying infectious bacteria, a liquid dispenser can itself become a harbour of infectious bacteria and the source of an outbreak thereof, spreading the infectious bacteria to each operator of the liquid dispenser. This can have life threatening and even lethal consequences, particularly in hospital settings in which hygiene control is paramount to patient safety. In this connection it is important to understand that exposure to air of a liquid soap over a long time can lead to degradation and contamination of the soap. Liquid dispensers that employ replaceable cartridges offer the advantage of potentially reducing contamination as new soap is not combined with old and potentially contaminated soap.

Dispensing liquid soap in the form of a foam offers numerous advantages: foam is easier to spread; there is less splashing or run-off owing to foam having a higher surface tension; and there is a reduced liquid requirement to provide the same cleansing power owing to the increased surface area. Foamed soap also offers an improved tactile and aesthetic quality; the soap feels less cold to the skin and operators typically associate foamed soap as providing a more pleasant and luxurious feel, being of superior quality and can even associate foamed soap with a cleaner, safer and more trustworthy product. However, stable foams are difficult to obtain, in particular from low cost, easy to manufacture inserts. The foams dispensed often being formed from large bubbles that disperse quickly. There is therefore a desire to improve the tactile experience of the operator by providing foams which feel richer, smoother and which are more stable.

As for dispensing foamed liquid soap, there are also advantages associated with foaming liquid soap employing suspended particles. These suspended particles can provide an abrasive effect on the skin, enhancing the cleaning capability of the liquid soap and therefore also potentially reducing the liquid requirement to provide the same cleaning power. Suspended particles are also associated with a higher quality, more luxurious product, partly owing to the familiarity and association with expensive facial cleansers employing suspend particles. Where suspended particles are present, it is common in the art for these to be of size in from 0.1-1 mm.

Thus employing liquid soap that is either foamed or which includes suspended particles, or both, offers more economical use of the liquid soap owing to intrinsic factors such as improved cleaning action and extrinsic factors such as improved aesthetic or tactile quality which can lead to operators being more inclined to want to effectively use the liquid soap.

Yet there are challenges associated with employing foamed liquid soap and liquid soap that utilises suspended particles, and particularly so when an attempt is made to combine them.

U.S. Pat. No. 8,002,151 discloses a liquid dispenser that employs a fixed pump and foaming mechanism into which a replaceable product cartridge containing a particle laden formulation is installed. Foaming of the particle laden liquid soap is achieved by sparging air into the liquid via a porous foaming element. Such liquid dispensers are typically large, well-engineered and long lasting devices. But in some situations, the irreplaceable nature of the fixed pump and foaming mechanism introduces a cleaning burden which is undesirable because there is the potential for increased contamination arising from the re-use of the fixed pump and foaming mechanism between cartridge replacements. This is because the pump and foaming mechanism itself is not replaced when the cartridge is replaced. The fixed foaming mechanism described in this document demands spatial dimensions that would be difficult to adapt for use in a smaller disposable insert arrangement facilitating replacement at the same time as replacement of the cartridge. This is partly because the system of U.S. Pat. No. 8,002,151 is complex. Complexity is not a major problem in fixed pumping systems but this mechanism could usefully be substituted for a simpler fixed system, which offers a foam quality which is at least as good, if not improved relative to the design disclosed therein.

U.S. Pat. No. 7,661,561 discloses a liquid dispenser that is capable of simultaneously dispensing a foamed liquid soap and a separate liquid that is laden with particles, these separately dispensed liquids then being amalgamated to provide a mixture of foam and liquid soap having suspended particles. The drawback of this arrangement is manufacturing complexity and increased maintenance burden owing to the inconvenience of requiring replacements of two separate liquid containers. Thus maintenance of the liquid supply is rendered complicated, as one container may become depleted before the other and vice versa.

U.S. Pat. No. 5,445,288 discloses a liquid dispenser comprising a disposable insert comprising foaming mechanism connected to a hygienically sealed collapsible container. Liquid is combined with air to create a comingled air/liquid mixture which is then passed through a porous membrane to form a foam. As compared with U.S. Pat. No. 8,002,151, one benefit of this liquid dispenser is that replacement of the container replaces the foaming mechanism, reducing the potential hazard of contamination resulting from improper maintenance of the liquid dispenser. A drawback of this arrangement however is that the foaming mechanism is not conducive to foaming liquid having particles suspended therein; there is an irresolvable tension between setting the pore size of the porous membrane sufficiently small for effective sparging and yet also large enough to allow suspended particles to pass through.

In view of the limitations and drawbacks discussed above, it would be desirable to provide a foaming component that is designed to foam a liquid comprising particles suspended therein and can provide high quality, tactile and stable foams, from such a liquid with the option of providing these advantages in dimensions suitable to enable it to be fitted to a dispenser as a replaceable part.

FIELD

There is disclosed a foaming component comprising: a liquid chamber; an air chamber; a sparging component comprising a sparging interface and a foaming region; an exit aperture; and a pumping mechanism, the pumping mechanism being arranged to: transfer liquid from the liquid chamber to the foaming region; transfer air from the air chamber, through the sparging interface, and to the foaming region, whereupon the forcing of air through the sparging interface causes bubbles to form in liquid in the foaming region forming a foamed mixture for dispensing; and transfer the foamed mixture from the sparging component to the exit aperture, wherein: the sparging interface is arranged such that at least a portion of the foaming region is disposed in between opposing surfaces of the sparging interface.

This arrangement can provide excellent sparging and therefore high quality foaming capability whilst offering the possibility of use in a small unit such as may be necessary to facilitate use of the sparging component in a replaceable disposable insert. This is made possible by arranging the sparging interface such that the foaming region is disposed between opposing surfaces of the sparging interface. Thus the sparging interface surrounds the foaming region and in a cross section air can enter through the sparging interface into the liquid from both sides of the foaming region. In the prior art the sparging interface is provided such that in a cross section air can only enter into the liquid from one side of the foaming region.

In other words, with the above-described arrangement the effective length of the sparging interface is significantly increased and may effectively be doubled. Thus the spatial requirements of the sparging mechanism are greatly reduced, giving improved sparging over a reduced volume. This reduction enables the sparging component to be reduced in size, and so employed in a replaceable disposable insert, or for a larger volume of air to be sparged into the liquid, and more points of turbulence applied, such that the foam produced is smooth, luxurious in perception and highly stable, providing an excellent operator experience. This can all be provided in a simple to manufacture form.

The foaming component may comprise a stationary section and a translatable section translatable within the stationary section; and the stationary section and translatable section may combine to form the liquid chamber and the air chamber. Thus a simplistic pumping mechanism is achieved.

The foaming component may be arranged such that the translation of the translatable section into the stationary section reduces both the volume of the liquid chamber and the volume of the air chamber thereby providing the pumping mechanism. Thus a simplistic mechanism is provided for simultaneously pumping air and liquid.

The volume of the air chamber may be made larger than the volume of the liquid chamber. One way to facilitate this is to dispose the air chamber around the liquid chamber. This facilitates matching of the air volume flow rate with the liquid volume flow rate to facilitate improved sparging.

The sparging component may be formed as part of the translatable section. This option may be employed where the sparging component is small, and will not unduly increase the weight of the translatable section. For instance, where the sparging component is small and intended to be disposable.

The foaming component may be arranged such that: the sliding and translatable sections are annular; the liquid chamber is centrally disposed; and the air chamber surrounds the liquid chamber. This configuration maximises the surface area of the liquid and hence exposure to the sparging interface, ensuring that the best quality foam per volume of liquid can be obtained.

The translatable section may be resiliently biased in a direction of increasing separation between the translatable section and the stationary section, thus requiring an external force to slide the translatable section into the stationary section thereby to effect pumping.

The sparging interface may define an outer surface surrounding an inner surface, a portion of the foaming region being disposed between the outer and inner surfaces. The outer surface may be outer in the sense of being radially outer. This arrangement facilitates the provision of flow of liquid in a direction perpendicular to the opposing surfaces of the sparging interface, offering improved sparging as air enters perpendicularly to the flow and also offering reduced interference to the flow arising owing to sparging. This arrangement helps to reduce the impact of the sparging interface on the flow of liquid.

The outer and/or inner surfaces may be annular. The provision of annular surfaces promotes an increase in effective sparging surface area per volume of sparging surface.

The outer and/or inner surfaces have a substantially fixed radius over a length thereof.

This facilitates a length over which there can be provided an influx of air into the liquid in a direction perpendicular to the direction of travel of the liquid. This also helps to reduce the impact of the sparging interface on the flow of liquid.

The outer surface and the inner surface may be concentrically disposed. This helps facilitate uniformity in the flow of liquid helping to provide a more uniform dispensed liquid.

The sparging interface may further define a bypass aperture in the outer surface through which bypass aperture air can be pumped into an air pocket formed within the inner surface, whereupon air can be forced through the inner surface into the portion of the foaming region disposed between the outer and inner surfaces. By channelling air in this way, it is possible to create a highly space-effective sparging mechanism.

A plurality of bypass apertures may be provided between the outer surface and the inner surface. This facilitates providing more uniform influx of air and reduced air friction arising owing to the interaction between the air and the bypass apertures.

The one or more bypass openings may be substantially perpendicular to the axis of the outer surface and/or to the axis of the inner surface.

In some examples, the sparging component may be formed as part of the stationary section. This can be advantageous where the sparging component is designed to maximise the foam quality, and so may be too large to be included in the translatable section for weight reasons.

As noted above, the sparging interface may define an outer surface surrounding an inner surface with a portion of the foaming region being disposed between these surfaces. In addition to this, the sparging component may be at least partially formed such that there is more than one zone to the foaming region. And that more than one zone is disposed between two sparging interfaces. For instance, there may be a first zone and a second zone, or multiple (third, fourth, fifth) zones of the foaming region. As such, the each or some of the zones may comprise an annular channel between sparging interfaces, such that the sparging interface defines a cylindrical zone between two surfaces of the sparging interface, these may be regarded as an outer surface of the liquid sparging interface and an inner surface of the liquid sparging interface, as described above. Specifically, it will generally be the case that the sparging interface defines a cylindrical first zone between two surfaces of the sparging interface.

It is possible, where the first zone is disposed between sparging interfaces, that translation of the translatable section causes foaming in the first zone of the foaming region and transfer of the foam to the second zone of the foaming region. This can improve the foam quality, as in effect, the size of the foaming region is increased as the liquid is sparged not just in a single zone. Further, transfer from one zone to another causes turbulence in the foam, reducing bubble size and improving foam quality. Therefore, the provision of more than one zone of the foaming region provides excellent conditions for producing a foam of the highest quality at the point of dispensing to the operator.

As described above, the second zone of the foaming region may also comprise an annular channel between sparging interfaces, or in other words the sparging interface may define a cylindrical foaming region between two surfaces of the sparging interface. Where both the first and second zones of the foaming region are to be found between two surfaces of the sparging interface, the two surfaces of the sparging interface of the first zone are generally different from the two surfaces of the sparging interface of the second zone. Such, that, for instance, the first and second zones of the foaming region will generally not just be a continuation of one another along, for instance, a flow axis, or if they are, there will be distinct regions separated by contortions in the sparging interfaces. By providing different sparging interfaces for each zone, a greater turbulence is provided in the flow of the liquid/foam from the liquid chamber to the outlet, reducing bubble size and providing for a smoother, more stable foam.

The annular channel of the second zone of the foaming region may be disposed within the annular channel of the first zone of the foaming region, and in these cases the annular channel of the second zone may be linked to the annular channel of the first zone by one or more foaming conduits. In other words, the sparging interfaces defining the first zone may be disposed within the sparging interfaces defining the second zone, and the first and second zones of the foaming region may be linked by one or more foaming conduits. The presence of the foaming conduit introduces yet further turbulence into the liquid/foam flow, with the resulting reduction in bubble size improving foam quality as described above.

Often the annular channel of the second zone will be centrally disposed within the annular channel of the first zone, such that the sparging interfaces defining the second zone of the foaming region are centrally disposed within the sparging interfaces defining the first zone of the foaming region. This configuration ensures balanced flow of the aerated liquid from the first zone to the second zone of the foaming region, such that the foam produced is homogeneous and so of consistent quality. Often, there will be two foaming conduits, to balance the desire that the flow path of the liquid from the first zone be constant against the increased manufacturing complexity of having multiple conduits. However, one, two, three, four or more conduits are possible.

There may be provided a liquid storage chamber for supplying liquid to the liquid chamber.

The foaming component may comprise a one-way valve between the liquid storage chamber and the liquid chamber arranged to permit fluid to flow from the liquid storage chamber to the liquid chamber.

The foaming component may comprise the liquid, which liquid is a soap comprising suspended particles therein. This could be a one-shot device for example.

The sparging interface may comprise a porous membrane.

The porous membrane may arranged to have a pore size sufficiently small to block suspended particles in the liquid from passing therethrough. This mitigates against clogging of the sparging component and interference between the particles and the influx of air. Typically, the pore size will be in the range 10-300 μm.

The pore size of the inner surface may be set to be different, preferably larger, to the pore size of the outer surface. This enables compensation to be made of the more tortuous air pathway that the air has to go through when going through the inner surface of the sparging interface.

The sparging interface may be formed from a wide range of materials, including, sintered polyethylene, sintered bronze, sintered stainless steel, micro porous materials, polytetrafluoroethylene (PTFE, e.g. GORTEX™), micro porous urethane (e.g. Porelle®), micro porous ceramics, non-woven polyester, acrylic mats or multi-layer stainless steel gauze, or combinations of these.

The foaming component may be suitable for a liquid dispenser.

There is also disclosed an insert comprising: the foaming component according to any of the above-described arrangements, wherein: the insert is arranged to be inserted into a liquid dispenser. The insert may comprise a cartridge for containing liquid. This will often be the case where the insert is disposable. In such cases, when replacing the cartridge of a liquid dispenser the foaming mechanism is also replaced, mitigating the potential for contamination to arise owing to failure to clean the foaming mechanism.

There is also disclosed a replacement cartridge for a liquid dispenser comprising the foaming component according to any one of the above-described arrangements, wherein the foaming component comprises a one-way liquid intake valve that is positioned between a liquid storage compartment of the replacement cartridge and the liquid chamber of the foaming component and arranged to enable liquid to flow in a direction from the storage compartment to the liquid chamber.

Unless otherwise stated each of the integers described may be used in combination with any other integer as would be understood by the person skilled in the art. Further, although all aspects of the invention preferably "comprise" the features described in relation to that aspect, it is specifically envisaged that they may "consist" or "consist essentially" of those features outlined in the claims. In addition, all terms, unless specifically defined herein, are intended to be given their commonly understood meaning in the art.

BRIEF DESCRIPTION OF THE FIGURES

In order that the invention may be more readily understood, it will be described further with reference to the figures and to the specific examples hereinafter.

DETAILED DESCRIPTION

Figure 1A:
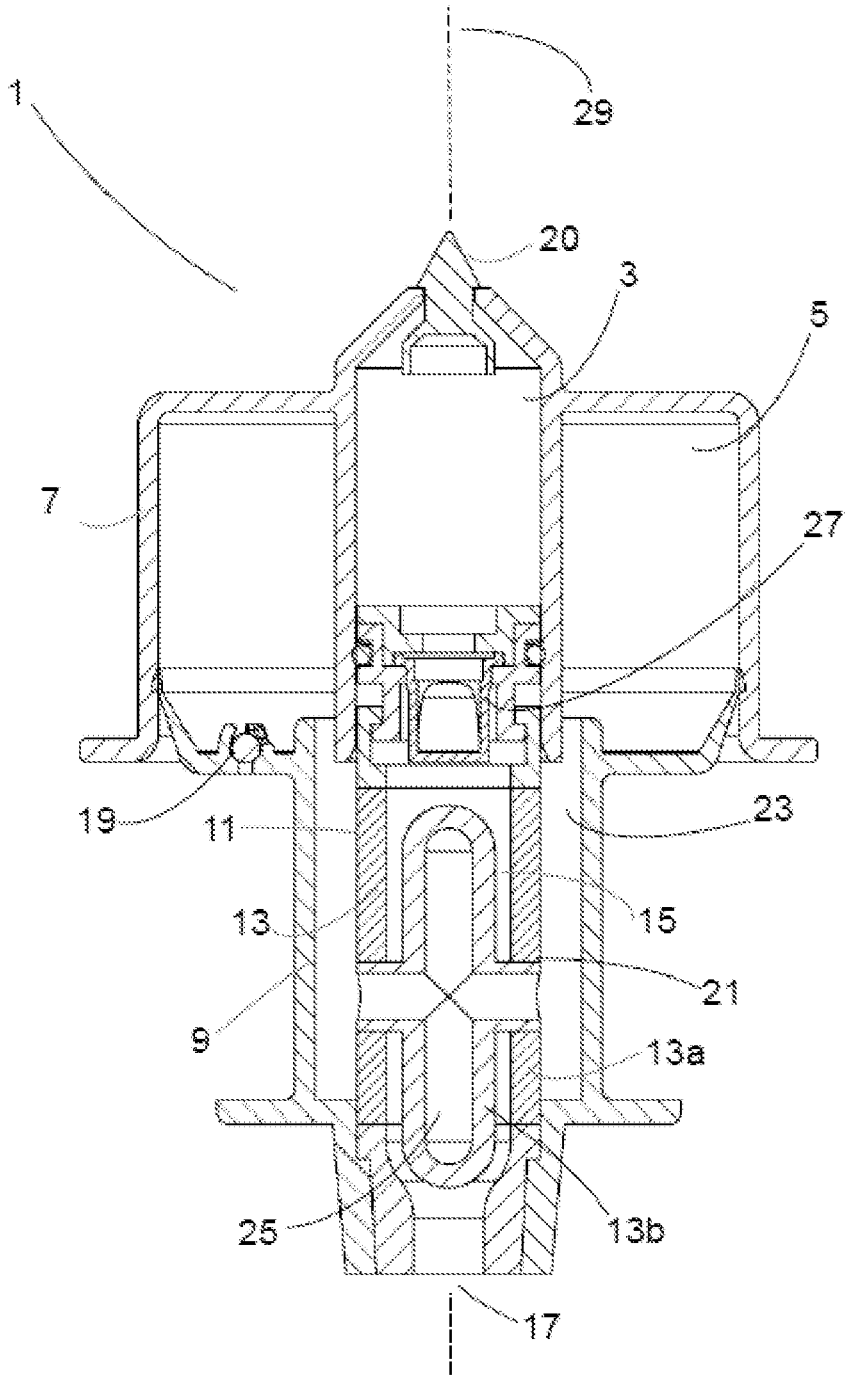
FIG. 1*a* shows a cross-section of a disposable insert comprising a foaming component.

FIG. 1*a* shows an exemplary foaming component 1 having a stationary section 7 and a translatable section 9 which combine to form a liquid chamber 3 and an air chamber 5. Attached to the translatable section 9 there is provided a sparging component 11 comprising a sparging interface 13 and defining a foaming region 15. It can be seen that the foaming region 15 is disposed between opposing surfaces of the sparging interface 13. In the exemplary arrangement shown, the sparging interface 13 comprises a radially outer surface 13*a* and a radially inner surface 13*b*. There is also provided bypass apertures 21. Both surfaces 13*a* and 13*b* are annular in cross-section and co-centric.

A one-way liquid intake valve 20 enables liquid to pass from outside the liquid chamber 3, through the liquid intake valve 20 and into the liquid chamber 3. Thus the foaming component 1 may be provided as part of a replacement cartridge for a liquid dispenser, wherein the liquid intake valve 20 is situated between a liquid storage chamber of the replacement cartridge and the liquid chamber 3 of the foaming component 1.

A one-way air intake valve 19 allows air to pass from outside the air chamber 5, through the air intake valve 19 into the air chamber 5.

Thus during a recharge stroke, which will be discussed below, air and liquid can be replenished into the liquid 3 and air 5 chambers. Of course, for one-shot liquid dispensers such recharging is not required.

There is also shown an exit aperture 17 through foamed liquid to be dispensed is ejected.

The basic operation of the foaming component 1 is as follows. The translatable section 9 is translated into the stationary section 7 effecting a compression of the liquid chamber 3 and the air chamber 5. Liquid is thus forced out of the liquid chamber 3, through a liquid transfer valve 27 into foaming region 15. Air is thus forced out of the air chamber 5 through an air channel 23. Some of this air then passes through the outer surface 13*a* of the sparging interface, whereupon the air is split into a multitude of air streams, into the liquid in the foaming region 15, whereupon air bubbles form in the liquid from the multitude of air streams and the liquid is foamed. The remainder of the air passes through the bypass aperture 21 into an air pocket 25 defined by the sparging interface 13 and then through the inner surface 13*b*, whereupon air is split into a further multitude of air streams, and passes into the liquid in the foaming region 15 causing further air bubbles to form in the liquid.

Thus the liquid in the foaming region 15 is sparged with air that is infused perpendicular to the direction of flow of the liquid and from two opposing directions in cross section. In other words, the liquid may be sandwiched in cross section between the opposing surfaces of the sparging interface. It will be recognised that in the exemplary arrangement however, the 3-dimensional geometry is such that the sparging interface defines between outer and inner surfaces thereof a substantially cylindrical foaming region. Air can then be sparged into the cylindrical foaming region in radially inward and outwards directions normal 5 to the cylinder surface.

The resulting foamed liquid is then dispensed through the exit aperture 17.

Figure 1B:
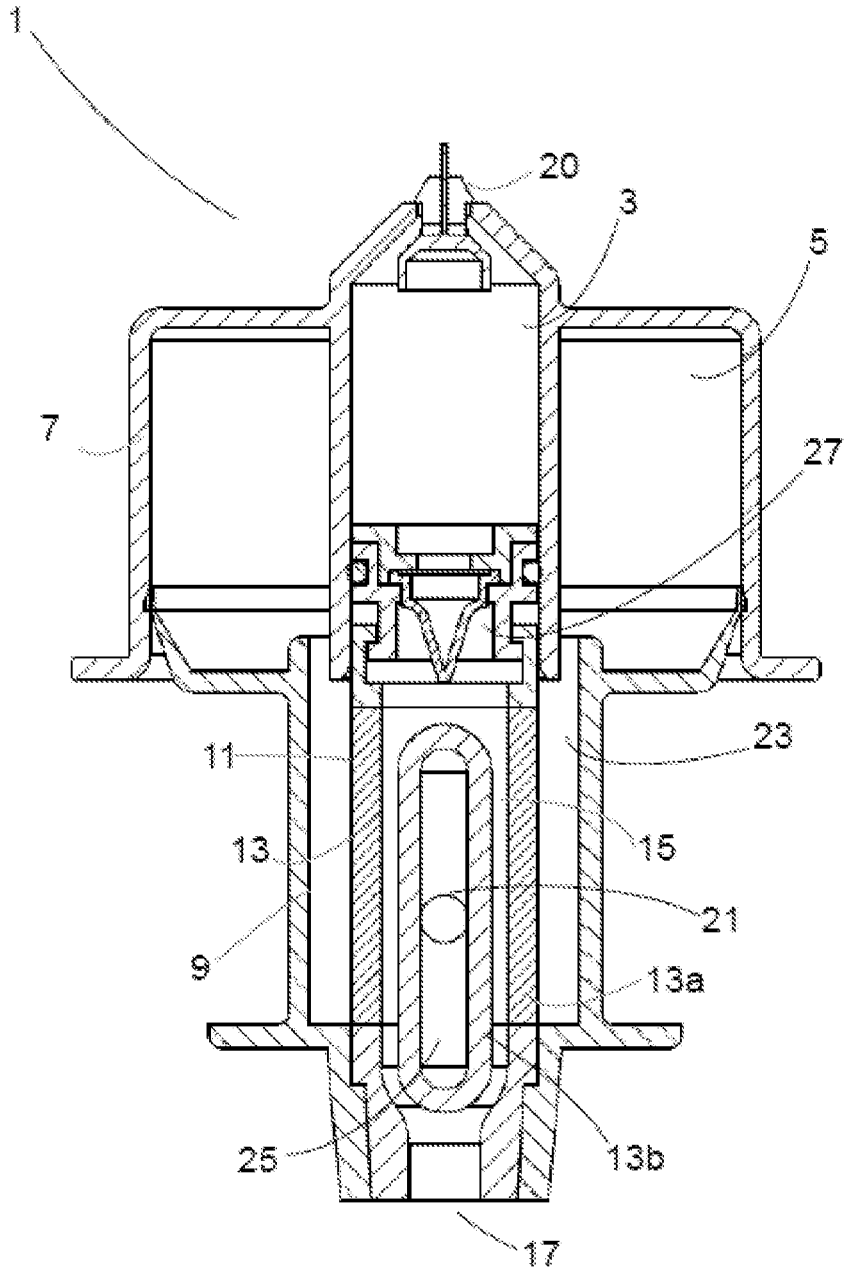
FIG. 1*b* shows the disposable insert of FIG. 1*a* having undergone a 90 degree rotation about the longitudinal axis of the disposable insert.

FIG. 1*b* shows the foaming component 1 shown in FIG. 1*a*, but rotated 90-degrees about a longitudinal axis 29 running length-wise through the foaming component 1. Thus the bypass apertures 21 have been rotated so that only one can be seen in FIG. 1*b*, with the other 10 being out of view.

The discharge stroke shall now be described in more detail with respect to FIGS. 2*a* to 2*c*. Certain reference signs have intentionally been omitted for the sake of clarity.

Figure 2C:
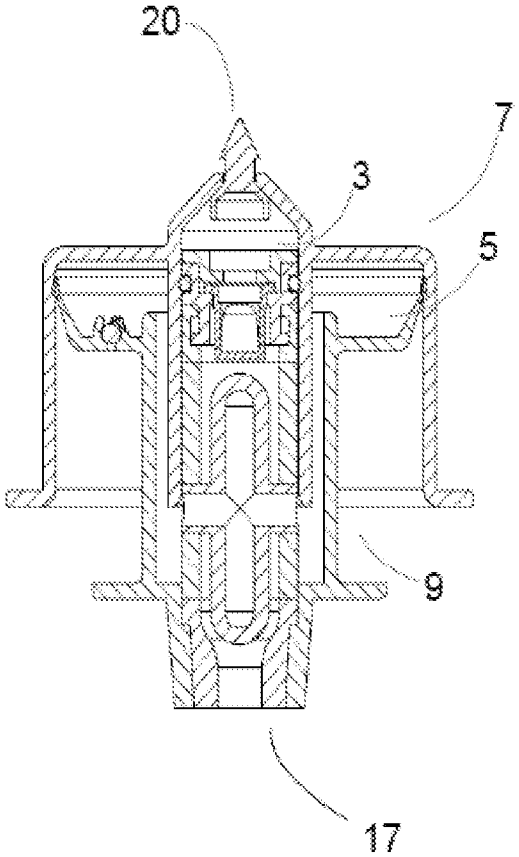
FIGS. 2*a-c* shows the sequential progression of a discharge stroke of the disposable insert.
Figure 2B:
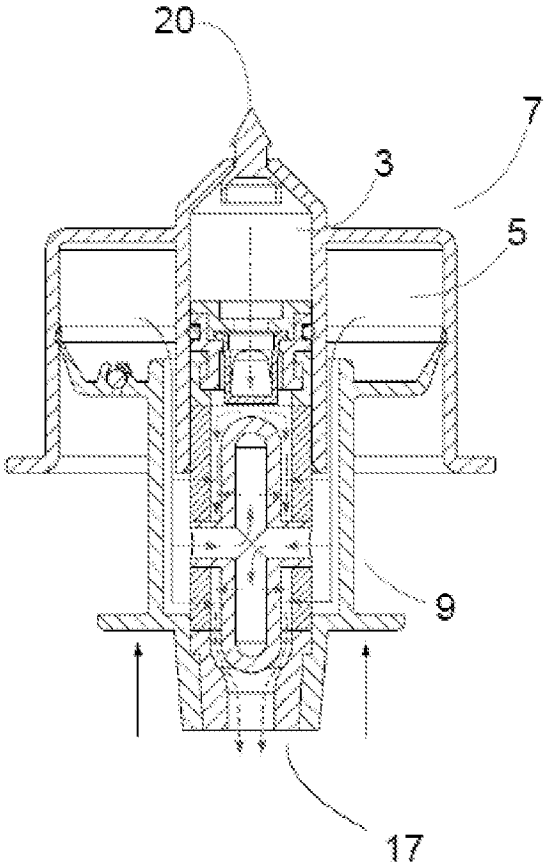
Figure 2A:
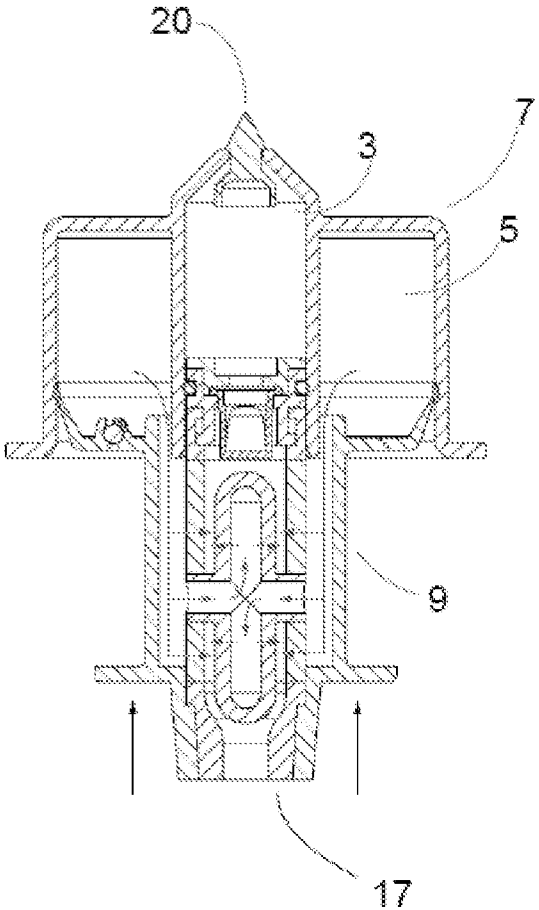

Generally, the volumes of the liquid 3 and air 5 chambers are shown to progressively decrease from FIGS. 2*a* to 2*c* as the stationary section 7 and translatable section 9 are brought together, resulting in positive pressure in the chambers and thus liquid and air being ejected therefrom resulting in foamed liquid being dispensed from the dispensing aperture 17 of the foaming component 1.

FIG. 2*a* shows the initiation of the discharge stroke in which the translatable section 9 of the foaming component 1 is pushed in the direction shown by the pair of vertical, upward pointing arrows into the stationary section. In this figure further arrows denote the resultant forcing of air from the air chamber 5, through the air channel 23, whereupon air is split such that one portion of the air is forced through the outer surface 13*a* of the sparging interface into liquid in the foaming region 15 and another portion of air is forced through the bypass aperture 21, into the air pocket 25, and finally forced through the inner surface 13*b* of the sparging interface. Thus as shown in the figure, air enters the foaming region 15 from both sides of the foaming region 15.

FIG. 2*b* shows the foaming component 1 mid-way through the discharge stroke and includes arrows denoting the flow of liquid from the liquid chamber 3, through the liquid transfer valve 27 whereupon it enters into the foaming region 15 and is aerated by air passing through the sparging interface 13 as described above. The air that enters into both sides of the foaming region 15 forms bubbles in the liquid owing to it having passed through the sparging interface 13 which is provided with holes of a sufficiently small diameter to promote the formation of bubbles in the liquid as air is passed through. The small diameter of the holes also prevents any particles suspended in the liquid from entering into the air pocket 25. Positive pressure inside the pocket 25 also helps prevent entry of particles into the pocket 25.

FIG. 2*c* shows the end of the discharge stroke. The volumes of the liquid 3 and air 5 chambers are at a minimum and no further foamed soap is dispensed.

In a one-shot system, the foaming component would now be depleted. It could then be discarded, replaced or manually recharged. But in the majority of applications it is desirable that the foaming component is automatically recharged following the completion of the discharge stroke. This may be achieved by employing a spring mechanism that serves to resiliently bias the stationary 7 and translatable 9 sections apart, such that following release of an application of a force to discharge at the end of the discharge stroke, the sections are automatically brought together through the action of the spring mechanism, whereupon the recharge stroke commences.

The recharge stroke shall now be described in more detail with respect to FIGS. 3*a* to 3*c*. Certain reference integers have again been omitted for the sake of clarity.

Figure 3C:
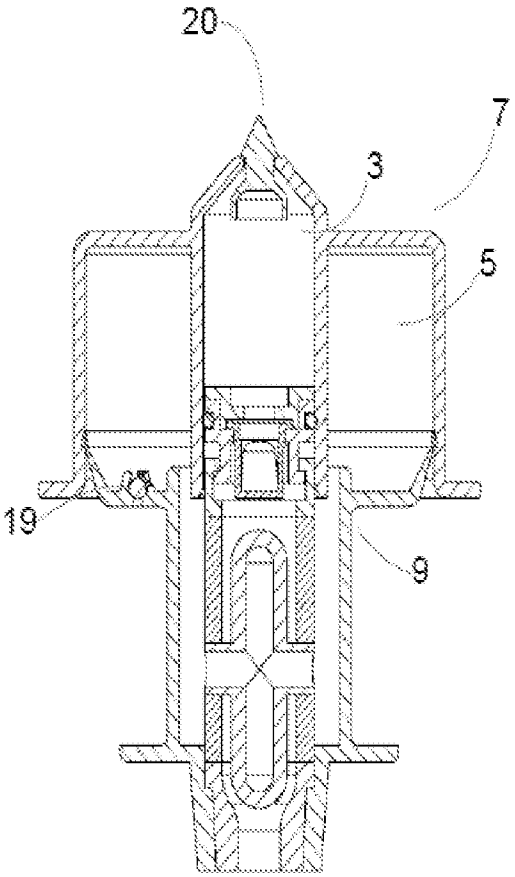
FIGS. 3*a-c* shows the sequential progression of the recharge stroke of the disposable insert.
Figure 3B:
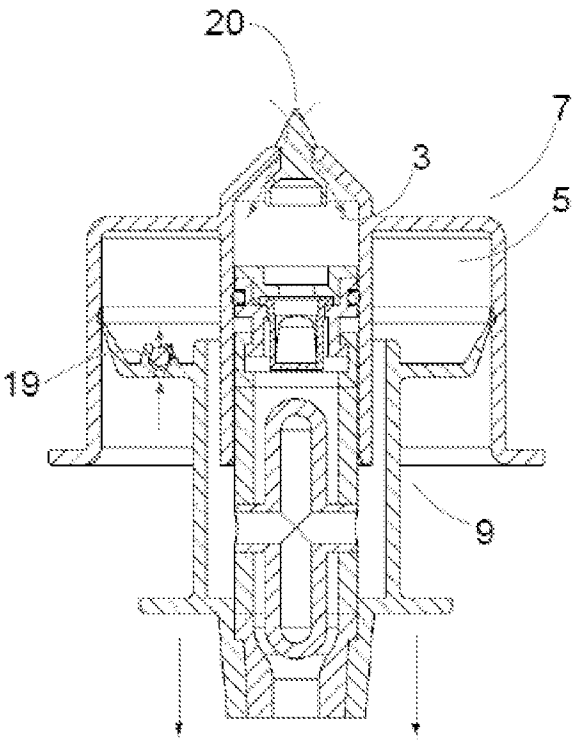
Figure 3A:
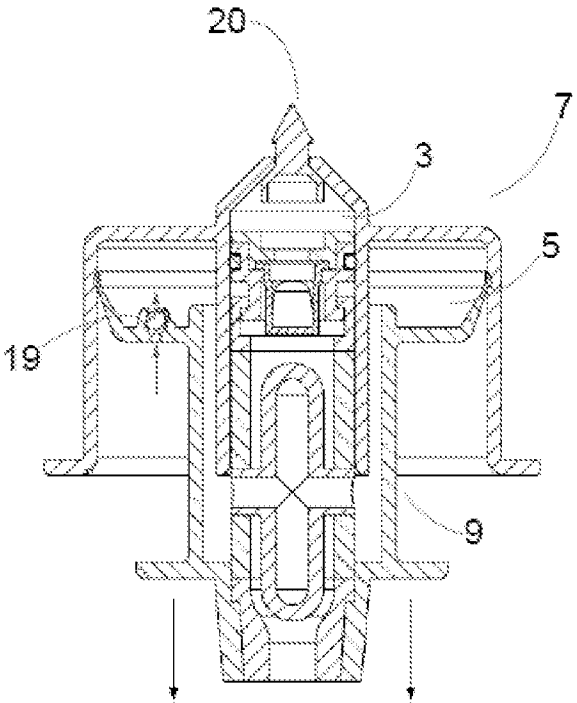

Generally, the volumes of the liquid 3 and air 5 chambers are shown to progressively increase from FIGS. 3*a* to 3*c* as the stationary section 7 and translatable section 9 are moved apart, resulting in negative pressure in the chambers and thus liquid being sucked into the liquid chamber 3 and air being sucked into the air chamber 5.

FIG. 3*a* shows the initiation of the recharge stroke in which the translatable section 9 is brought in a direction of separation from the stationary section 7 in the direction of the vertical, downward pointing arrows. This results in negative pressure in the air chamber 5 causing air to be sucked in from the outside, through the one-way air intake valve 19, and into the air chamber 5, in the direction shown by the arrows by the valve 19 in the figure. Employing the air intake valve 19 helps avoid residue foam from a previous discharge operation being sucked up into and potentially clogging the device.

FIG. 3*b* shows the foaming component 1 mid-way through the recharge stroke and it is shown how liquid during the recharge stroke is sucked via negative pressure created inside the liquid chamber 3, from liquid outside the foaming component 1, through the one-way liquid intake valve 20, and into the liquid chamber 3 thereby to replenish the liquid chamber 3. The smaller arrows in the figure show the direction of travel of the liquid through the liquid intake valve 20.

FIG. 3*c* shows the foaming component 1 at the point of completion of the recharge stroke. The liquid chamber 3 and air chamber 7 are fully replenished with liquid and air respectively, ready for a discharge stroke.

Although the term recharge is used, it is to be considered that the same stroke could 5 be employed in order to prime the foaming component 1 before the first discharge stroke.

Figure 4A:
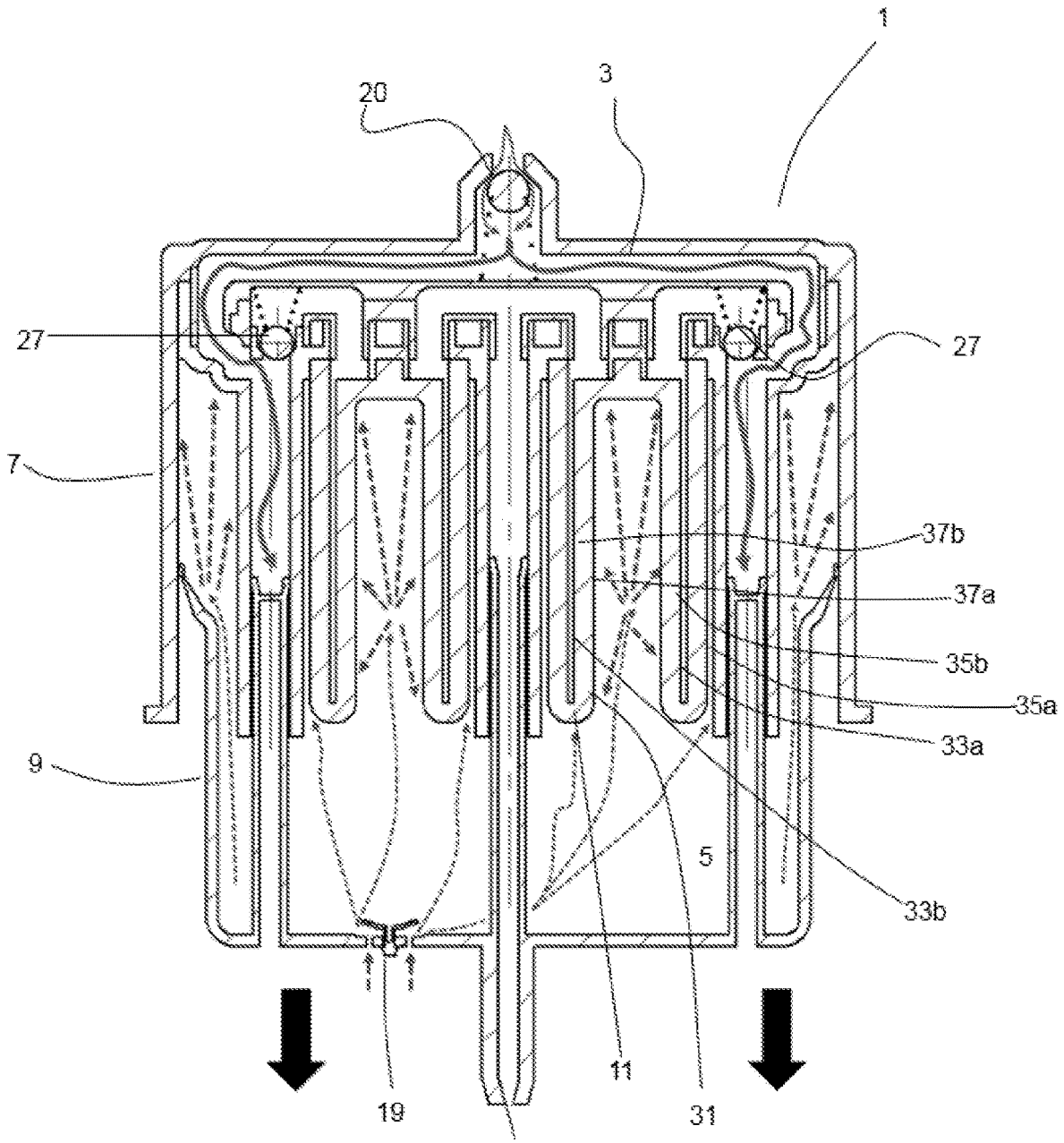
FIG. 4*a* shows a cross-section of a fixed insert comprising a foaming component, charging of the insert with liquid is illustrated (evenly dashed lines correspond to air and solid lines to liquid).
Figure 4B:
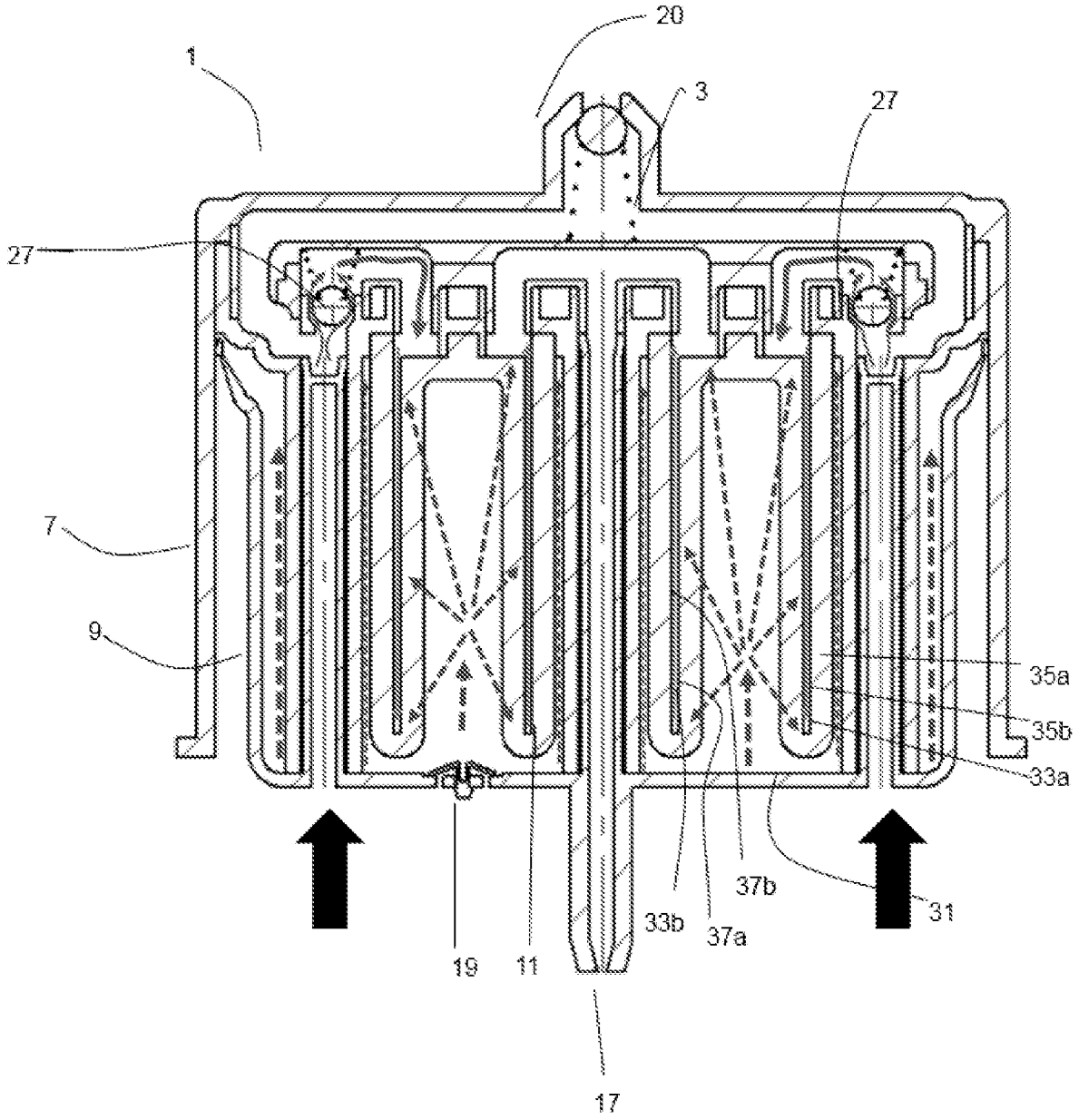
FIG. 4*b* shows the disposable insert of FIG. 4*a* during actuation.
Figure 5A:
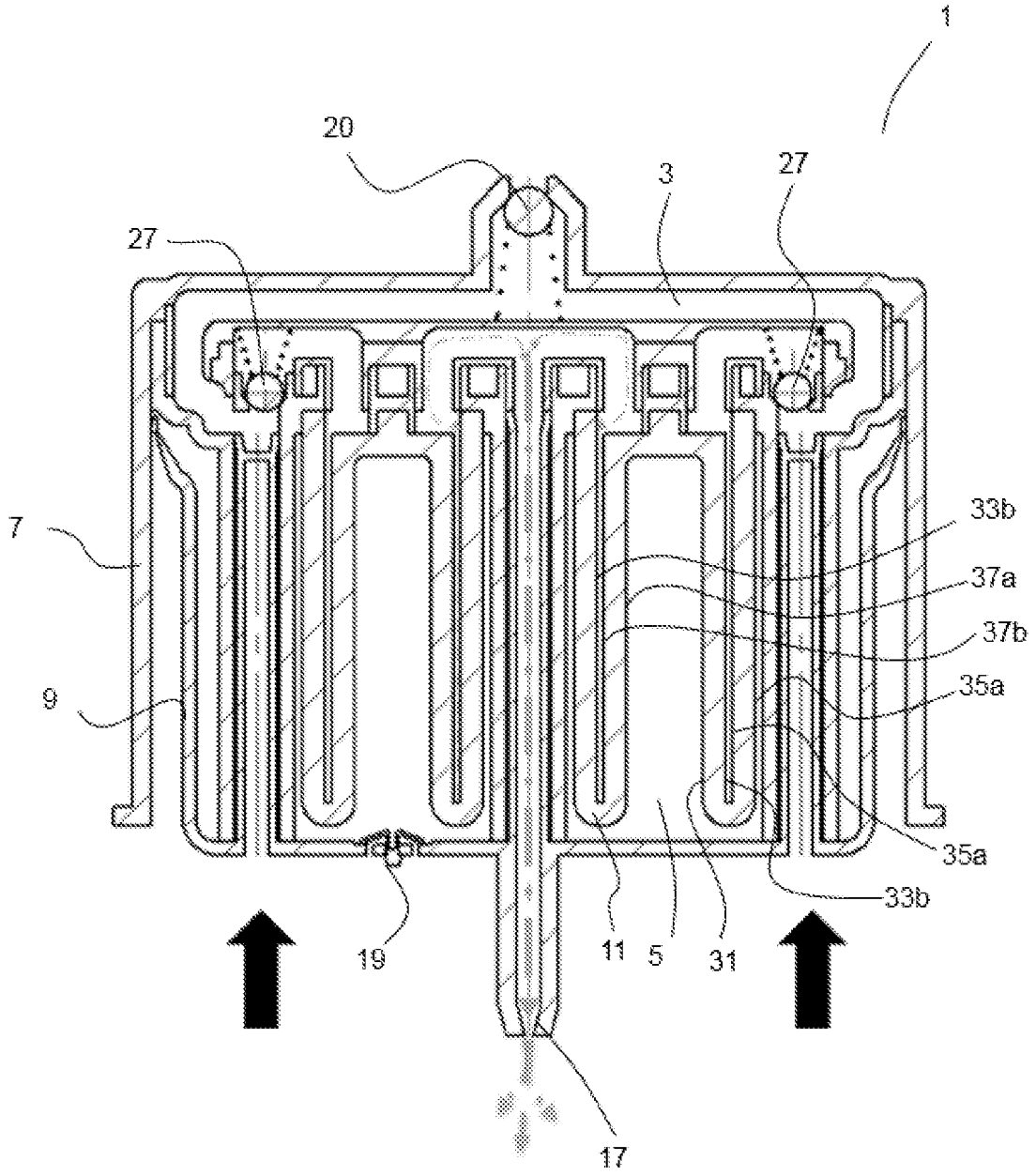
FIGS. 5*a* and 5*b* show foam production and flow (dot-dashed lines correspond to foam) in the insert of FIGS. 4*a* and 4*b*.
Figure 5B:
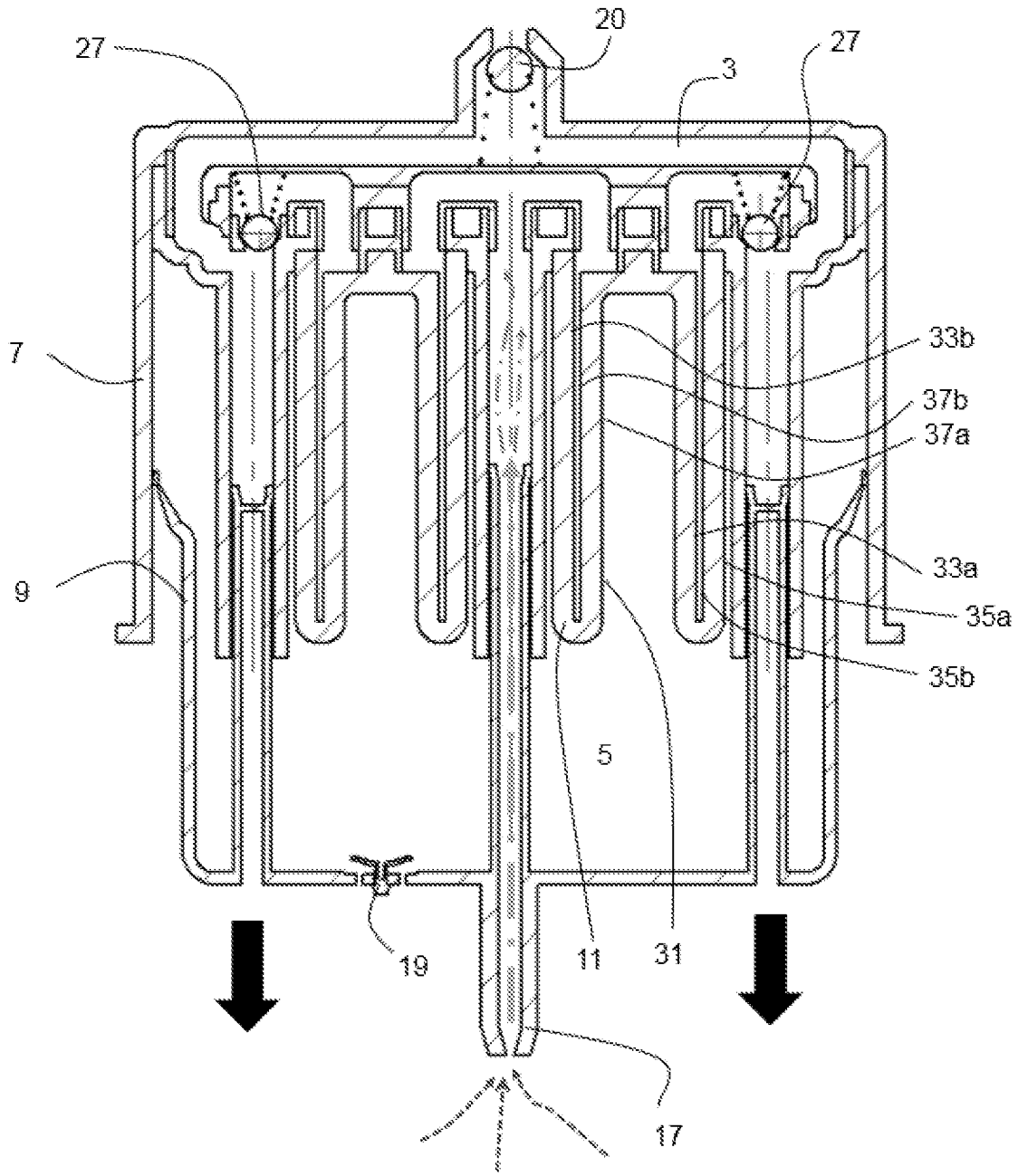
Figure 6:
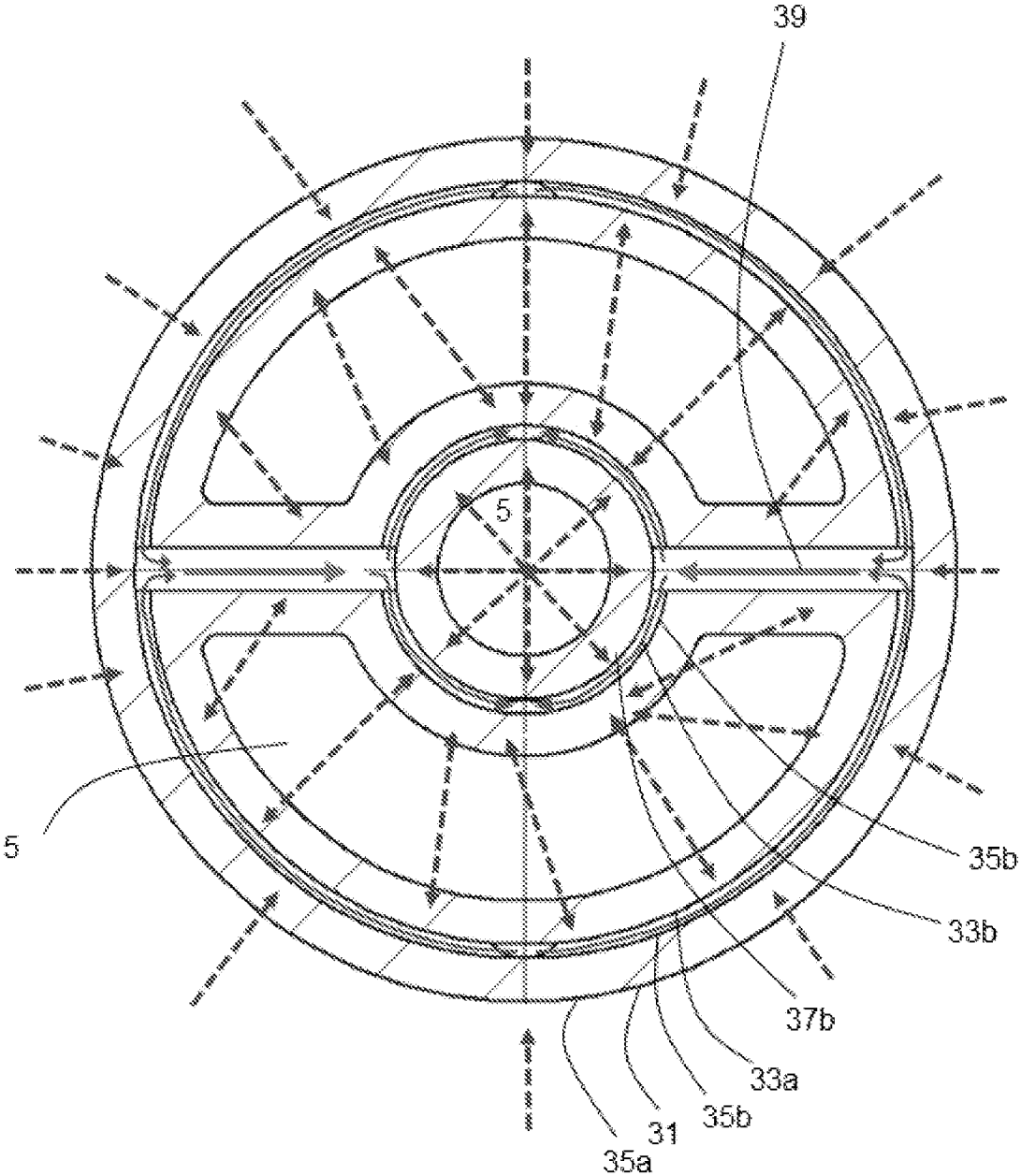
FIG. 6 shows the sparging component of the insert of FIGS. 4 and 5 in cross-section 90° through the lateral axis of the insert.

In the example of FIGS. 4-6, there is provided an example of a fixed foaming component 1 having stationary section 7 and translatable section 9 which combine to form a liquid chamber 3 and an air chamber 5. Attached to the stationary section 7 there is provided a sparging component 11, comprising sparging interface 31. The foaming region 33 is disposed between opposing surfaces of the sparging interface 31. The foaming region 33 of this example comprises two zones, a first zone 33*a* and a second zone 33*b*. As can be seen, in particular from FIG. 6, the sparging interface 31 of the first zone 33*a* of the foaming region 33 comprises a radially outer surface 35*a* and a radially inner surface 35*b*. The sparging interface 31 of the second zone 33*b* of the foaming region 33 also comprises a radially outer surface 37*a* and a radially inner surface 37*b*. There is also provided two foaming conduits 39. As with the first example, both surfaces of the sparging interfaces 31 of the first 33*a* and second zones 33*b* of the foaming region 33 are annular in cross-section and co-centric.

As with the first example, a one-way liquid intake valve 20 is present, allowing the liquid to be provided in replaceable cartridges. The one-way air intake valve 19 is also present in this example. Both intake valves 19, 20 function as described above for the first example.

The operation of the foaming component 1 of this example is as follows. A charge of liquid is provided through intake valve 20, which closes when the liquid chamber 3 is full. The translatable section 9 is translated into the stationary section 7 effecting a compression of the liquid chamber 3 and the air chamber 5. Liquid is thus forced out of the liquid chamber 3, through a liquid transfer valve 27 into the first zone 33*a* of foaming region 33 and then through the foaming conduits 39 into the second zone 33*b* of foaming region 33. It will be appreciated that the structure of the foam will change as it flows from the first zone 33*a* of the foaming region 33 through the foaming conduits 39 to the second zone 33*b* of the foaming region 33 and to the exit aperture 17. Initially, the foam may be an aerated liquid, or a foam with large unstable bubbles, however, the turbulence applied to the foam as it passes through this tortuous flow path causes the bubbles in the foam to collapse, such that the foam contains multiple small bubbles. This provides a smooth stable foam. Foaming occurs as described above, through the forcing of air out of the air chamber 5 through the sparging component 11 and the resulting foam is dispensed through exit aperture 17.

It should be appreciated that the processes and apparatus of the invention are capable of being implemented in a variety of ways, only a few of which have been illustrated and described above.

The invention claimed is:

1. A foaming component comprising:

a liquid chamber;

an air chamber;

a sparging component comprising a sparging interface and a foaming region;

an exit aperture; and a pumping mechanism, the pumping mechanism being arranged to:

transfer soap comprising suspended particles therein from the liquid chamber to the foaming region without passing through the sparging interface; transfer air from the air chamber, through the sparging interface, and to the foaming region, whereupon the forcing of air through the sparging interface causes bubbles to form in the soap containing suspended particles therein in the foaming region forming a foamed mixture for dispensing; and transfer the foamed mixture from the sparging component through the exit aperture, wherein the sparging interface is arranged such that at least a portion of the foaming region is disposed in between opposing surfaces of the sparging interface.

2. The foaming component according to claim 1, wherein:

the foaming component comprises a stationary section and a translatable section that is translatable with respect to the stationary section; and the stationary section and translatable section combine to form the liquid chamber and the air chamber.

3. The foaming component according to claim 2, wherein:

the foaming component is arranged such that translation of the translatable section towards the stationary section reduces both the volume of the liquid chamber and the volume of the air chamber thereby providing the pumping mechanism.

4. The foaming component according to claim 2 wherein:

the translatable section is resiliently biased in a direction of increasing separation from the stationary section, thus requiring an external force to translate the translatable section towards the stationary section thereby to effect pumping.

5. The foaming component according to claim 2, wherein: the sparging component is formed as part of the translatable section.

6. The foaming component according to claim 2, wherein: the translatable and stationary sections are annular; the liquid chamber is centrally disposed; and the air chamber surrounds the liquid chamber.

7. The foaming component according to claim 2, wherein: the sparging component is formed as part of the stationary section.

8. The foaming component according to claim 1, wherein: the sparging interface defines a cylindrical foaming region between inner and outer surfaces of the sparging interface.

9. The foaming component according to claim 8, wherein: the outer and/or inner surfaces are annular.

10. The foaming component according to claim 8, wherein: the outer and/or inner surfaces have a substantially fixed radius over a length thereof.

11. The foaming component according to claim 8, wherein: the outer and inner surfaces are concentrically disposed.

12. The foaming component according to claim 8, wherein: the sparging interface further defines a bypass aperture in the outer surface through which bypass aperture air can be pumped into an air pocket formed within the inner surface, whereupon air can be forced through the inner surface into the portion of the foaming region disposed between the outer and inner surfaces.

13. The foaming component according to claim 12, further comprising: a plurality of bypass apertures defined by the sparging interface.

14. The foaming component according to claim 13, wherein the plurality of bypass apertures are substantially perpendicular to the tangent of the outer surface and/or to the tangent of the inner surface, and wherein the plurality of bypass apertures are substantially perpendicular to a central axis of the outer surface and/or inner surface.

15. The foaming component according to claim 8, wherein: a pore size of the inner surface of the sparging interface is different to a pore size of the outer surface of the sparging interface, wherein the pore size of the inner surface of the sparging interface is greater than the pore size of the outer surface of the sparging interface.

16. The foaming component according to claim 1, wherein: the sparging interface defines an outer surface surrounding an inner surface, a portion of the foaming region being disposed between the outer and inner surfaces.

17. The foaming component according to claim 1, wherein: the sparging component is formed such that the foaming region comprises more than one foaming zone.

18. The foaming component according to claim 17, wherein the foaming region comprises a first zone, which is disposed between two sparging surfaces of the sparging interface.

19. The foaming component according to claim 18, wherein translation of the translatable section causes foaming of soap comprising suspended particles therein in the first zone of the foaming region and transfer of the foamed soap comprising suspended particles therein to a second zone of the foaming region.

20. The foaming component according to claim 18, wherein translation of the translatable section causes foaming of soap comprising suspended particles therein in the first zone of the foaming region and transfer of the foamed soap comprising suspended particles therein to a second zone of the foaming region.

21. The foaming component according to claim 20, wherein the sparging interface defines a cylindrical first zone of the foaming region between two surfaces of the sparging interface.

22. The foaming component according to claim 21, wherein the two surfaces of the sparging interface of the first zone are different from two surfaces of the sparging interface of the second zone.

23. The foaming component according to claim 22, wherein the two surfaces of the sparging interface of the second zone are disposed within the two surfaces of the sparging interface of the first zone, and wherein the first and second zones are linked by one or more foaming conduits.

24. The foaming component according to claim 23, wherein the two surfaces defining the second zone are centrally disposed within the two surfaces defining the first zone.

25. The foaming component according to claim 23, wherein there are two foaming conduits.

26. The foaming component according to claim 1, further comprising: a liquid storage chamber for supplying soap comprising suspended particles therein to the liquid chamber.

27. The foaming component according to claim 15, further comprising: a one-way valve between the liquid storage chamber and the liquid chamber arranged to permit fluid to flow from the liquid storage chamber to the liquid chamber.

28. The foaming component according to claim 16, wherein: the sparging interface comprises a porous membrane.

29. The foaming component according to claim 17, wherein: the porous membrane is arranged to have a pore size in the range 10-300 μm.

30. The foaming component according to claim 1, wherein: the foaming component is for a liquid dispenser.

31. An insert comprising:

a foaming component comprising:

a liquid chamber;

an air chamber;

a sparging component comprising a sparging interface and a foaming region;

an exit aperture; and a pumping mechanism, the pumping mechanism being arranged to:

transfer soap comprising suspended particles therein from the liquid chamber to the foaming region without passing through the sparging interface; transfer air from the air chamber, through the sparging interface, and to the foaming region, whereupon the forcing of air through the sparging interface causes bubbles to form in the soap containing suspended particles therein in the foaming region forming a foamed mixture for dispensing; and transfer the foamed mixture from the sparging component through the exit aperture, wherein the sparging interface is arranged such that at least a portion of the foaming region is disposed in between opposing surfaces of the sparging interface, wherein the insert is arranged to be inserted into a liquid dispenser.

32. An insert according to claim 31, wherein the insert is disposable.

33. A liquid dispenser comprising a foaming component, the foaming component comprising:

a liquid chamber;

an air chamber;

a sparging component comprising a sparging interface and a foaming region;

an exit aperture; and a pumping mechanism, the pumping mechanism being arranged to:

transfer soap comprising suspended particles therein from the liquid chamber to the foaming region without passing through the sparging interface; transfer air from the air chamber, through the sparging interface, and to the foaming region, whereupon the forcing of air through the sparging interface causes bubbles to form in the soap containing suspended particles therein in the foaming region forming a foamed mixture for dispensing; and transfer the foamed mixture from the sparging component through the exit aperture, wherein the sparging interface is arranged such that at least a portion of the foaming region is disposed in between opposing surfaces of the sparging interface.

34. A liquid dispenser according to claim 33, further comprising an insert, wherein the insert comprises the foaming component.

35. A liquid dispenser according to claim 34, wherein the insert is disposable.

* * * * *